US012419420B2

(12) United States Patent
Huang et al.

(10) Patent No.: US 12,419,420 B2
(45) Date of Patent: Sep. 23, 2025

(54) SOFA

(71) Applicant: GUANGDONG SWEETNIGHT INNOVATION TECHNOLOGY CO., LTD., Foshan (CN)

(72) Inventors: Shuimu Huang, Maoming (CN); Yiqun Chen, Guangzhou (CN); Yimeng Li, Zhaoqing (CN); Zijian Zhang, Zhanjiang (CN)

(73) Assignee: GUANGDONG SWEETNIGHT INNOVATION TECHNOLOGY CO., LTD., Foshan (CN)

( * ) Notice: Subject to any disclaimer, the term of this patent is extended or adjusted under 35 U.S.C. 154(b) by 169 days.

(21) Appl. No.: 18/307,981

(22) Filed: Apr. 27, 2023

(65) Prior Publication Data

US 2024/0358155 A1 Oct. 31, 2024

(51) Int. Cl.

| | |
|---|---|
| ***A47C 5/00*** | (2006.01) |
| ***A47C 4/00*** | (2006.01) |
| ***A47C 4/02*** | (2006.01) |
| ***A47C 13/00*** | (2006.01) |

(52) U.S. Cl.

CPC ..... *A47C 4/021* (2013.01); *A47C 4/02* (2013.01); *A47C 5/005* (2013.01); *A47C 13/005* (2013.01)

(58) Field of Classification Search

CPC ..... A47C 13/005; A47C 7/624; A47C 5/005; A47C 4/02

See application file for complete search history.

(56) References Cited

U.S. PATENT DOCUMENTS

| | | | | |
|---|---|---|---|---|
| 4,311,337 | A * | 1/1982 | Brunn | A47C 1/124 297/440.22 |
| 5,890,767 | A * | 4/1999 | Chang | A47C 7/546 297/440.22 |
| 6,241,317 | B1 * | 6/2001 | Wu | A47C 4/02 297/440.1 |
| 8,974,139 | B2 * | 3/2015 | Saul | F16B 12/125 297/440.1 |
| 10,081,282 | B2 * | 9/2018 | Line | B60N 2/72 |
| 11,457,742 | B1 * | 10/2022 | Zhang | A47C 4/02 |

(Continued)

FOREIGN PATENT DOCUMENTS

| | | | |
|---|---|---|---|
| CN | 207100956 U | * | 3/2018 |
| CN | 112702937 A | * | 4/2021 |

(Continued)

*Primary Examiner* — Timothy J Brindley

(74) *Attorney, Agent, or Firm* — HOWARD M COHN and Associates, LLC

(57) ABSTRACT

A sofa belonging to a technical field of household sofas and being simple in assembly and disassembly and suitable for small dwelling-size apartment is provided. The sofa includes a bottom box, two groups of wing-type armrests, a backrest, two groups of seat cushions, and two groups of backrest cushions. The two groups of the wing-type armrests expand outward and are symmetrically connected to side walls of the bottom box. The backrest is connected to the two groups of the wing-type armrests. The two groups of the seat cushions are disposed on the bottom box. The two groups of the backrest cushions abut against the backrest. Bottom sides of the two groups of the backrest cushions abut against upper surfaces of the two groups of the seat cushions.

7 Claims, 2 Drawing Sheets

(56) References Cited

U.S. PATENT DOCUMENTS

| | | | | |
|---|---|---|---|---|
| 2007/0132301 | A1* | 6/2007 | Yu | A47C 4/02 297/440.23 |
| 2012/0119629 | A1* | 5/2012 | Nelson | A47C 7/546 312/111 |
| 2016/0249742 | A1* | 9/2016 | Xie | A47C 4/028 297/440.23 |
| 2018/0035811 | A1* | 2/2018 | Frankel | A47C 4/286 |
| 2018/0289165 | A1* | 10/2018 | King | A47C 7/40 |
| 2020/0054139 | A1* | 2/2020 | Morley, Jr. | A47C 4/22 |
| 2020/0100592 | A1* | 4/2020 | Policicchio | A47C 17/02 |
| 2020/0268160 | A1* | 8/2020 | Kuhl | A47C 17/86 |
| 2020/0375362 | A1* | 12/2020 | Hale | A47C 17/04 |
| 2021/0068547 | A1* | 3/2021 | Hodgson | A47C 7/42 |
| 2022/0133047 | A1* | 5/2022 | Chen | A47C 13/005 297/440.22 |
| 2022/0248854 | A1* | 8/2022 | Purchas | A47C 4/52 |
| 2023/0209262 | A1* | 6/2023 | Nelson | A47C 7/727 381/301 |
| 2024/0065446 | A1* | 2/2024 | Parsa | F16B 12/54 |

FOREIGN PATENT DOCUMENTS

| | | | | |
|---|---|---|---|---|
| DE | 202024000506 | U1 * | 6/2024 | |
| WO | WO-2016044885 | A1 * | 3/2016 | A47C 15/002 |

* cited by examiner

SOFA

TECHNICAL FIELD

The present disclosure relates to a technical field of household sofas, and in particular to a sofa being simple in assembly and disassembly and suitable for small dwelling-size apartment.

BACKGROUND

Sofas are one kind of software furniture provided with armrests respectively on both sides, and specifically belong to chairs having multiple seats with soft cushions and back chairs assembled with springs, thick foam plastic, etc. Nowadays, the sofas gradually become an essential household article in daily life.

A usable floor area in an apartment of each family is different. For some small dwelling-size apartment users, large-sized sofas may not be applicable for small dwelling-size apartments, and in daily life of the small dwelling-size apartment users, the sofas may be disassembled and stored when the sofas are not in use within a certain period of time. However, sofas applicable for the small dwelling-size apartments in the prior art generally fastened and assembled through screws, which is inconvenient to disassemble. In addition, there is no place to store assemblies of a disassembled sofa, which cannot meet storage standards of the small dwelling-size apartment users.

SUMMARY

In order to solve problems that sofas applicable for the small dwelling-size apartments in the prior art are inconvenient to disassemble and store, the present disclosure provides a sofa being simple in assembly and disassembly and suitable for small dwelling-size apartment.

In order to achieve the above objectives, the present disclosure adopts following technical solutions.

The present disclosure provides a sofa, including a bottom box, two groups of wing-type armrests, a backrest, two groups of seat cushions, and two groups of backrest cushions.

The two groups of the wing-type armrests expand outward and are symmetrically connected to side walls of the bottom box. The backrest is connected to the two groups of the wing-type armrests. The two groups of the seat cushions are disposed on the bottom box. The two groups of the backrest cushions abut against the backrest. Bottom sides of the two groups of the backrest cushions abut against upper surfaces of the two groups of the seat cushions.

Furthermore, first clamping plates are fixedly connected to the two groups of the wing-type armrests. Second clamping plates are fixedly connected to the side walls of the bottom box. The second clamping plates are respectively clamped to the first clamping plates.

Furthermore, first clamping holes are defined on the first clamping plates. Second clamping holes are defined on the second clamping plates. The first clamping holes and the second clamping holes are the same in size. The first clamping holes include four groups of the first clamping holes and four groups of the second clamping holes. The four groups of the first clamping holes are symmetrically distributed on the first clamping plates. The four groups of the second clamping holes are symmetrically distributed on the second clamping plates.

Furthermore, third clamping plates are further fixedly connected to the two groups of the wing-type armrests. Fourth clamping plates are fixedly connected to the backrest. The third clamping plates are respectively clamped to the fourth clamping plates.

Furthermore, third clamping holes are defined on the third clamping plates. Fourth clamping holes are defined on the fourth clamping plates. The third clamping holes and the fourth clamping holes are the same in size. The third clamping holes include four groups of the third clamping holes and the fourth clamping holes include four groups of the fourth clamping holes. The four groups of the third clamping holes are symmetrically distributed on the third clamping plates. The four groups of the fourth clamping holes are symmetrically distributed on the fourth clamping plates.

In order to improve storage effect of the sofa, furthermore, storage bags are fixedly connected to the two groups of the wing-type armrests.

In order to improve overall stability of the sofa, furthermore, supporting seats are inserted into bottom sides of the two groups of the wing-type armrests. Inserting rods are fixedly connected to the supporting seats. Inserting holes are defined with respect to the inserting rods on the bottom sides of the two groups of the wing-type armrests.

In order to improve comfort for users after sitting down, furthermore, when the bottom sides of the two groups of the backrest cushions abut against the upper surfaces of the two groups of the seat cushions, an included angle formed by the two groups of backrest cushions and the two groups of the seat cushions is 105 degrees.

In order to increase a sitting depth of the sofa, furthermore, a length of each of the two groups of the seat cushions is 60 cm.

Optionally, seventy-two groups of bagged independent springs are disposed in the two groups of the seat cushions. Interiors of the two groups of the seat cushions are filled with high-density sponge. Snakelike springs are disposed in the bottom box, and high-elasticity bandages are wound on the snakelike springs.

Compared with the prior art, the present disclosure provides the sofa, which has following beneficial effects.

According to the sofa, the first clamping plates and the third clamping plates, disposed on the two groups of the wing-type armrests, are respectively clamped with the second clamping plates on the bottom box and the fourth clamping plates on the backrest. During assembly and disassembly, the assembly may be completed only by adopting bidirectional clamping rods, which is more convenient and faster in the assembly and the disassembly. According to the sofa of the present disclosure, sofa accessories, the backrest cushions, the seat cushions, and the two groups of the wing-type armrests may be stored in the bottom box, so that a usable floor area of a small dwelling-size apartment where the sofa configured is increased, and storing the sofa accessories through the bottom box is easier for transporting the sofa.

Figure 1:
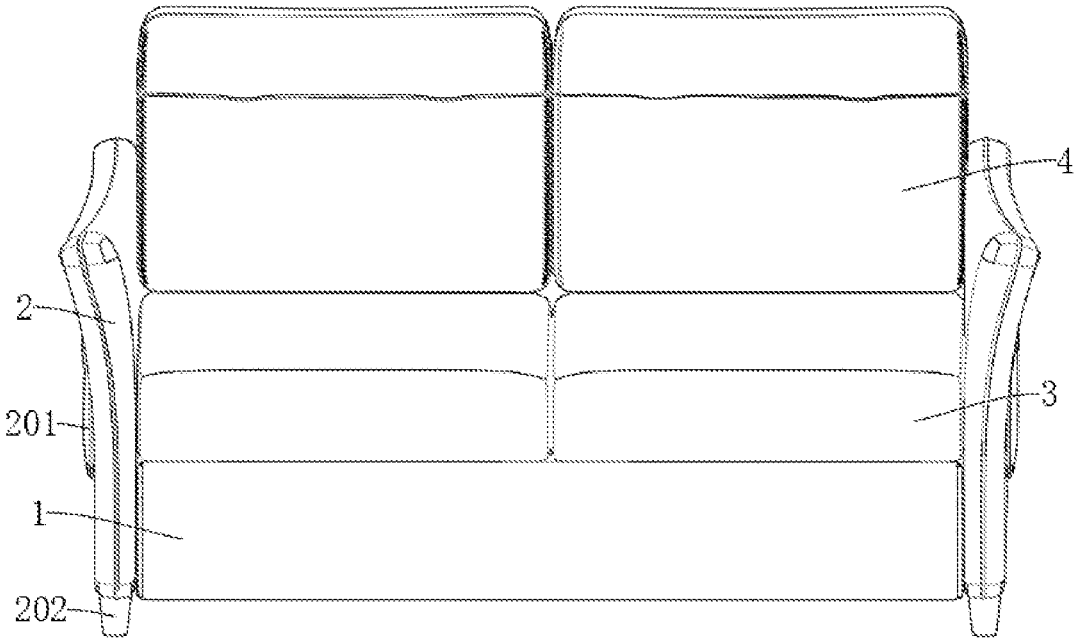
FIG. 1 is a first structural schematic diagram of a sofa according to one embodiment of the present disclosure.

Reference number in the drawings: 1. bottom box; 101. second clamping plate; 1011. second clamping hole; 2. wing-type armrest; 201. storage bag; 202. supporting seat; 2021. inserting rod; 203. first clamping plate; 2031. first clamping hole; 204. third clamping plate; 2041. third clamping hole; 3. seat cushion; 4. backrest cushion; 5. backrest; 501. fourth clamping plate; 5011. fourth clamping hole; 601. bidirectional clamping rod.

DETAILED DESCRIPTION

Technical solutions in embodiments of the present disclosure are clearly and completely described below with reference to drawings in the embodiments of the present disclosure, and obviously, the described embodiments are only a part of the embodiments of the present disclosure rather than all of the embodiments.

Embodiment 1

Figure 2:
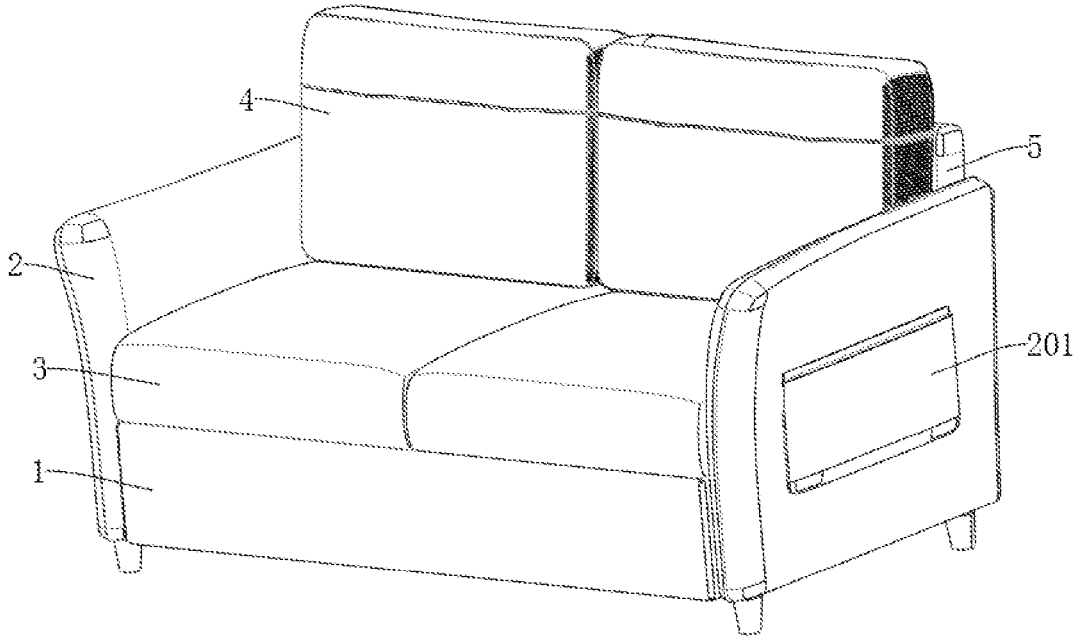
FIG. 2 is a second structural schematic diagram of the sofa according to one embodiment of the present disclosure.
Figure 3:
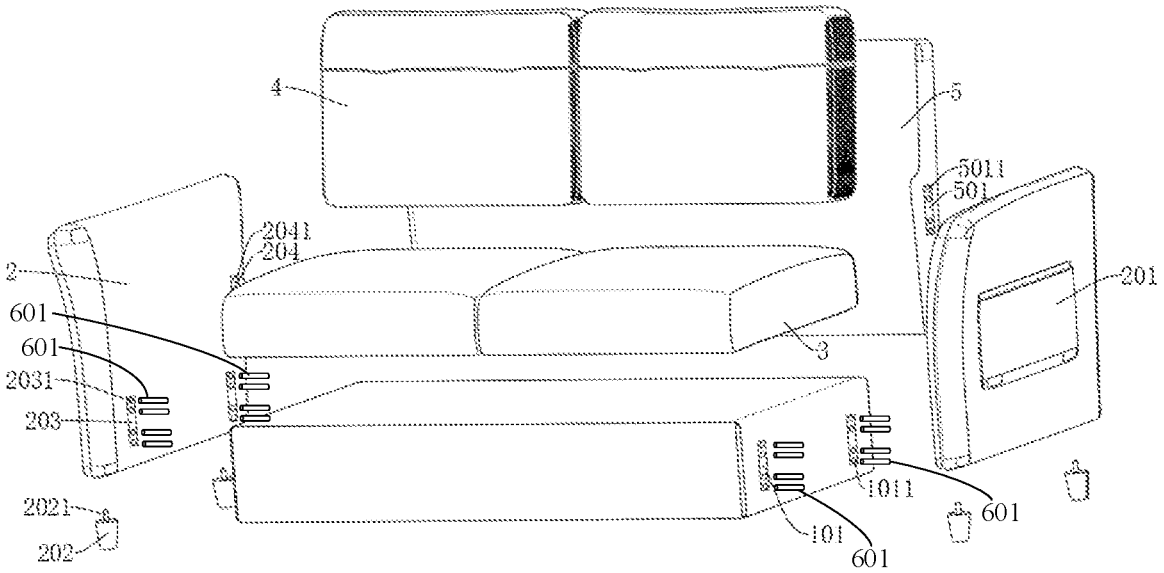
FIG. 3 is an exploded schematic diagram of the sofa according to one embodiment of the present disclosure.

Referring to FIGS. 1-3, the present disclosure provides a sofa, including a bottom box 1, two groups of wing-type armrests 2, a backrest 5, two groups of seat cushions 3, and two groups of backrest cushions 4.

The two groups of the wing-type armrests 2 expand outward and are symmetrically connected to side walls of the bottom box 1. The backrest 5 is connected to the two groups of the wing-type armrests 2. The two groups of the seat cushions 3 are disposed on the bottom box 1. The two groups of the backrest cushions 4 abut against the backrest 5. Bottom sides of the two groups of the backrest cushions 4 abut against upper surfaces of the two groups of the seat cushions 3.

First clamping plates 203 are fixedly connected to the two groups of the wing-type armrests 2. Second clamping plates 101 are fixedly connected to the side walls of the bottom box 1. The second clamping plates 101 are respectively clamped to the first clamping plates 203.

First clamping holes 2031 are defined on the first clamping plates 203. Second clamping holes 1011 are defined on the second clamping plates 101. The first clamping holes 2031 and the second clamping holes 1011 are the same in size. The first clamping holes 2031 include four groups of the first clamping holes 2031 and the second clamping holes 1011 include four groups of the second clamping holes 1011. The four groups of the first clamping holes 2031 are symmetrically distributed on the first clamping plates 203. The four groups of the second clamping holes 1011 are symmetrically distributed on the second clamping plates 101.

Third clamping plates 204 are further fixedly connected to the two groups of the wing-type armrests 2. Fourth clamping plates 501 are fixedly connected to the backrest 5. The third clamping plates 204 are respectively clamped to the fourth clamping plates 501.

Third clamping holes 2041 are defined on the third clamping plates 204. Fourth clamping holes 5011 are defined on the fourth clamping plates 501. The third clamping holes 2041 and the fourth clamping holes 5011 are the same in size. The third clamping holes 2041 include four groups of the third clamping holes 2041 and the fourth clamping holes 5011 include four groups of the fourth clamping holes 5011. The four groups of the third clamping holes 2041 are symmetrically distributed on the third clamping plates 204. The four groups of the fourth clamping holes 5011 are symmetrically distributed on the fourth clamping plates 501.

Storage bags 201 are fixedly connected to the two groups of the wing-type armrests 2.

By means of fixedly connecting the storage bags 201 to the two groups of the wing-type armrests 2, users may store a certain amount of articles using the storage bags 201 and also store household sundries using the storage bags 201 to a certain extent, so that a usable floor area of a small dwelling-size apartment is increased.

Supporting seats 202 are inserted into the bottom sides of the two groups of the wing-type armrests 2. Inserting rods 2021 are fixedly connected to the supporting seats 202. Inserting holes are defined with respect to the inserting rods 2021 on the bottom sides of the two groups of the wing-type armrests 2.

When the bottom sides of the two groups of the backrest cushions 4 abut against the upper surfaces of the two groups of the seat cushions 3, an included angle formed by the two groups of backrest cushions 4 and the two groups of the seat cushions 3 is 105 degrees.

The included angle formed by the two groups of backrest cushions 4 and the two groups of the seat cushions 3 is 105 degrees. Through the included angle of 105 degrees formed by the two groups of backrest cushions 4 and the two groups of the seat cushions 3, the users may slightly lean backward after sitting down, which is more in line with spine curve of a human body, and further relaxes the human body and relieves fatigue.

A length of each of the two groups of the seat cushions 3 is 60 cm.

The length of each of the two groups of the seat cushions 3 is set to be 60 cm, so that sitting depth is increased, and sitting comfort for the users is further improved.

Seventy-two groups of bagged independent springs are disposed in the two groups of the seat cushions 3. Interiors of the two groups of the seat cushions 3 are filled with high-density sponge.

The seventy-two groups of the bagged independent springs and 35D dry density high-resilience sponge fillers are disposed in the two groups of the seat cushions 3, so that strong support is given while the user sits on the two groups of the seat cushions 3 providing a soft and full sitting experience, thereby giving the two groups of the seat cushions 3 a plentiful sitting experience.

Snakelike springs are disposed in the bottom box 1, and high-elasticity bandages are wound on the snakelike springs.

The snakelike springs are made of refined steel, so that the bottom box 1 is integrally stressed during use, and the sofa body is firmly supported for a long time.

Referring to FIGS. 1-3, in an assembly process, a first end of each of a plurality of bidirectional clamping rods 601 is respectively into first clamping holes 2031 and third clamping holes 2041 on one of the two groups of the wing-type armrests 2. After the first end of each of the plurality of the bidirectional clamping rods 601 is fixedly inserted, a second end of each of the plurality of the bidirectional clamping rods 601 inserted into the first clamping holes 2031 is aligned with the second clamping holes 1011, and a second end of each of the plurality of the bidirectional clamping rods 601 inserted into the third clamping holes 2041 is aligned with the fourth clamping holes 5011. After alignment, the one of the two groups of the wing-type armrests 2 are pushed to respectively clamp the plurality of the bidirectional clamping rods 601 respectively into the second clamping holes 1011 and the fourth clamping holes 5011, thereby completing fixation the one of the two groups of the wing-type armrests 2. The other one of the two groups of the wing-type armrests 2 is further fixed according to the above way.

Referring to FIG. 2, in an assembly process, the two groups of the seat cushions 3 are placed on the bottom box 1, and after that, the two groups of backrest cushions 4 are leaned against the backrest 5. At the moment, the included angle formed by the two groups of backrest cushions 4 and the two groups of the seat cushions 3 is 105 degrees, and through the included angle of 105 degrees formed by the two groups of backrest cushions 4 and the two groups of the seat cushions 3, the user may slightly lean backwards after sitting down, which is more in line with spine curve of the human body, and further relaxes the human body and relieves fatigue.

Referring to FIG. 2, the length of each of the two groups of the seat cushions 3 is set to be 60 cm, so that the sitting depth is increased, and the sitting comfort for the users is further improved.

Referring to FIG. 2, by means of fixedly connecting the storage bags 201 to the two groups of the wing-type armrests 2, the users may store the certain amount of articles using the storage bags 201 and also store household sundries using the storage bags 2 to a certain extent, so that the usable floor area of the small dwelling-size apartment is increased.

Referring to FIG. 1, by setting armrests as the wing-type armrests 2, the wing-type armrests 2 have a certain degree of curvature.

Embodiment 2

The present disclosure further provides another embodiment of the sofa, which is basically the same as the sofa in Embodiment 1, and furthermore, a width size of the backrest 5 is the same as a width size of the bottom box 1.

A storage cavity is defined in the bottom box 1.

Referring to FIGS. 1-3, in a storage process, the four groups of supporting seats 202 are pulled down and then placed in the storage cavity, the two groups of wing-type armrests 2 are detached and then placed in the storage cavity, the backrest cushions 4 and seat cushions 3 are placed in a vacuum suction bag for vacuum pumping and compressing and then placed in the storage cavity. After storage, the backrest 5 is placed on the bottom box 1.

According to the sofa of the present disclosure, sofa accessories, the backrest cushions, the seat cushions, and the two groups of the wing-type armrests may be stored in the bottom box, so that the usable floor area of the small dwelling-size apartment where the sofa configured is increased, and storing the sofa accessories through the bottom box is easier for transporting the sofa.

Above descriptions are only preferred embodiments of the present disclosure, but a protection scope of the present disclosure is not limited thereto. Any familiar with technical field disclosed by the present disclosure is within technical range disclosed by the present disclosure, and technical scheme and inventive concept of the present disclosure are equally replaced or changed, which should be covered within the protection scope of the present disclosure.

What is claimed is:

1. A sofa, comprising:

a bottom box;

two wing-type armrests;

a backrest;

two seat cushions; and two backrest cushions;

wherein the two wing-type armrests expand outward and are symmetrically connected to two side walls of the bottom box respectively; wherein the backrest is connected to the two wing-type armrests; wherein the two seat cushions are disposed on the bottom box; wherein the two backrest cushions abut against the backrest, and bottom sides of the two backrest cushions abut against upper surfaces of the two seat cushions;

wherein each of the two wing-type armrests comprises two first clamping plates that are fixedly connected to an inner side of the wing-type armrest facing towards the bottom box and are respectively disposed on a front end and a rear end of a lower portion of the wing-type armrest; wherein each of the two side walls of the bottom box comprises two second clamping plates that are fixedly connected to the side wall of the bottom box are respectively disposed on a front end and a rear end of the side wall, wherein the two second clamping plates are respectively clamped to the two first clamping plates;

wherein there is defined a plurality of first clamping holes in each of the two first clamping plates, and there is defined a plurality of second clamping holes in each of the two second clamping plates, wherein the plurality of first clamping holes and the plurality of second clamping holes are equal in size; wherein the plurality of first clamping holes comprise a total of four groups of first clamping holes, with each group being disposed on the respective first clamping plate, and the four groups of first clamping holes are symmetrically distributed on the two first clamping plates; wherein the plurality of second clamping holes comprise four groups of second clamping holes, with each group being disposed on the respective second clamping plate, and the four groups of second clamping holes are symmetrically distributed on the two second clamping plates;

wherein there is further disposed a third clamping plate that is fixedly connected to each of the two wing-type armrests, wherein there is further disposed a fourth clamping plate that is fixedly connected to each of two sides of the backrest, and wherein the two third clamping plates are respectively connected to the two fourth clamping plates; wherein there is defined a plurality of third clamping holes in each third clamping plate, and there is further defined a plurality of fourth clamping holes in each fourth clamping plates, and wherein the plurality of third clamping holes and the plurality of fourth clamping holes are equal in size; wherein the plurality of third clamping holes comprise four groups of third clamping holes that are symmetrically distributed on the third clamping plates, and wherein the plurality of fourth clamping holes comprise four groups of fourth clamping holes that are symmetrically distributed on the fourth clamping plates;

wherein the sofa is assembled using a plurality of bidirectional clamping rods, wherein a first end of each of the plurality of bidirectional clamping rods is inserted into the respective first clamping hole or the respective third clamping hole in each of the two wing-type armrests, and a second end of each of the plurality of bidirectional clamping rods is aligned with respective second clamping hole or the respective fourth clamping hole, and wherein after alignment, each of the two wing-type armrests is pushed towards the backrest and the bottom box allowing each of the plurality of bidirectional clamping rods to be inserted into the respective second clamping hole or the respective fourth clamping hole, thereby achieving fixation of each of the two wing-type armrests.

2. The sofa according to claim 1, wherein storage bags are fixedly connected to the two wing-type armrests.

3. The sofa according to claim 2, wherein supporting seats are inserted into bottom sides of the two wing-type armrests, inserting rods are fixedly connected to the supporting seats, and inserting holes are defined with respect to the inserting rods on the bottom sides of the two wing-type armrests.

4. The sofa according to claim 1, wherein when the bottom sides of the two backrest cushions abut against the upper surfaces of the two seat cushions, an included angle formed by each of the two backrest cushions and each of the two seat cushions is 105 degrees.

5. The sofa according to claim 4, wherein a length of each of the two seat cushions is 60 cm.

6. The sofa according to claim 1, wherein seventy-two bagged independent springs are disposed in the two seat cushions, and interiors of the two seat cushions are filled with high-density sponge; and snakelike springs are disposed in the bottom box, and high-elasticity bandages are wound on the snakelike springs.

7. The sofa according to claim 1, wherein the respective third clamping plate is disposed on an upper portion of the inner side of the armrest and is aligned with the respective fourth clamping plate disposed on the corresponding side of the backrest.

* * * * *